US007965048B2

(12) United States Patent
Lin et al.

(10) Patent No.: US 7,965,048 B2
(45) Date of Patent: Jun. 21, 2011

(54) SWITCHING CONVERTER FOR LIGHTING WITH LIGHT INTENSITY AS FEEDBACK AND LIGHT EMITTING APPARATUS USING THE SAME

(75) Inventors: Yuh-Min Lin, San Ramon, CA (US); Cheng-Chung Shih, Fremont, CA (US)

(73) Assignee: Capella Microsystems, Corp., Tortola (VG)

( * ) Notice: Subject to any disclaimer, the term of this patent is extended or adjusted under 35 U.S.C. 154(b) by 412 days.

(21) Appl. No.: 12/252,699

(22) Filed: Oct. 16, 2008

(65) Prior Publication Data

US 2010/0097009 A1 Apr. 22, 2010

(51) Int. Cl.
*H05B 37/02* (2006.01)

(52) U.S. Cl. ..... 315/297; 315/127

(58) Field of Classification Search ..... 315/127, 315/294, 297

See application file for complete search history.

(56) References Cited

U.S. PATENT DOCUMENTS

| | | | | |
|---|---|---|---|---|
| 6,095,661 | A * | 8/2000 | Lebens et al. | 362/184 |
| 6,611,610 | B1 * | 8/2003 | Stam et al. | 382/104 |
| 7,511,695 | B2 * | 3/2009 | Furukawa et al. | 345/102 |
| 7,638,754 | B2 * | 12/2009 | Morimoto et al. | 250/226 |
| 7,740,371 | B1 * | 6/2010 | Lebens et al. | 362/205 |

* cited by examiner

*Primary Examiner* — Don P Le
(74) *Attorney, Agent, or Firm* — WPAT, P.C.; Anthony King

(57) ABSTRACT

A light emitting apparatus comprises a light emitting element and a switching converter comprising a conversion circuit for converting an operating electric signal to generate the driving electric signal, a feedback circuit having a light detecting element for detecting a luminous intensity of the light emitting element and generating a feedback signal, and a control circuit for receiving the feedback signal, comparing the received feedback signal with a reference electric signal, and controlling the conversion circuit based on comparison results to adjust the driving electric signal. Alternatively, the light detecting element detects ambient light and the control circuit controls the conversion circuit based on comparison results to stop or enable outputting of the driving electric signal.

14 Claims, 8 Drawing Sheets

SWITCHING CONVERTER FOR LIGHTING WITH LIGHT INTENSITY AS FEEDBACK AND LIGHT EMITTING APPARATUS USING THE SAME

FIELD OF THE INVENTION

The present invention relates to a switching converter for lighting, and more particularly to a high efficient switching converter capable of receiving light intensity as feedback, and to a light emitting apparatus using such high efficient switch converter.

BACKGROUND OF THE INVENTION

Most prior art light emitting systems using light emitting diodes (LEDs) would include a light detecting circuit. One of the purposes of using the light detecting circuit is to stabilize the luminous intensity of the light emitting system. The light detecting circuit is used for detecting the luminous intensity of the light emitting system, and the detected luminous intensity is then compared with a preset luminous intensity, and the driving voltage of the LEDs is adjusted based on comparison results, so that the luminous intensity of the light emitting system can be maintained at the preset luminous intensity. The driving voltage is generated by a voltage converter module. In order for the voltage convert module to convert an input voltage into a specified output voltage, a feedback circuit is needed within the voltage converter module. Another purpose of using the light detecting circuit is to save power consumption of the light emitting system. The light detecting circuit is used to detect ambient light. When the detected luminous intensity is higher than a threshold value, it means that the ambient light of the light emitting system is bright enough without activating the light emitting system, so that the LEDs are stopped emitting light until the detected luminous intensity is lower than the threshold value. By then, the LEDs are driven to emit light again.

FIG. 1 illustrates a block diagram of a light emitting system in prior art. As shown, the light emitting system 1 comprises an LED 11, a light detecting circuit 12, a control module 13, an output voltage adjuster 132 and a voltage converter module 14. The voltage converter module 14 is capable of receiving an operating voltage and generating an output voltage 15 to the LED 11 for driving the LED 11 to emit light. The light detecting circuit 12 is capable of detecting luminous intensity of light emitted from the LED 11, and transmits the detected luminous intensity value 121 to the control module 13. The output voltage adjuster 132 is connected between the control module 13 and the voltage converter module 14 and capable of adjusting the voltage of the out signal of the control module to fit the requirement of the voltage converter module 14. The control module 13 compares the detected luminous intensity value 121 with a preset luminous intensity value 131, and then controls the voltage converter module 14 to output the output voltage 15 according to the comparison results. For example, when the detected luminous intensity value 121 is lower than the preset luminous intensity value 131, the control module 13 would control the voltage converter module 14 to raise the output voltage 15, so as to drive the LED 11 to emit even brighter light. And, when the detected luminous intensity value 121 is higher than the preset luminous intensity value 131, the control module 13 controls the voltage converter module 14 to lower the output voltage 15, so that the LED 11 emits less bright light.

The conventional voltage converter module 14 comprises at least a comparison circuit 141, a feedback circuit 142, and a conversion circuit 143. The conversion circuit 143 is controlled by the comparison circuit 141 to raise or lower the output voltage 15. The feedback circuit 142 is connected to the output of conversion circuit 143 to receive the output voltage 15 and feed a feedback signal 144 to the comparison circuit 141. The comparison circuit 141 checks the voltage value fed back by the feedback circuit 142 and then adjusts the conversion circuit 143 according to the checking result.

In the above-described light emitting system 1 in prior art, the light detecting circuit 12 feeds back the luminous intensity value and then the voltage converter module 14 is then controlled to change the output voltage 15. Meanwhile, the voltage converter module 14 also internally comprises a feedback circuit 142 to control the output voltage 15. Therefore, the circuitry design for the light emitting system 1 in prior art has the disadvantages of having low power efficiency and consuming unnecessary power.

SUMMARY OF THE INVENTION

Therefore, one of objects of the present invention is to provide a switching converter with light intensity as feedback and a light emitting apparatus using the same, so as to enhance the power efficiency of the light emitting apparatus and avoid unnecessary power consumption by the apparatus.

Another object of the present invention is to provide a switching converter with light intensity as feedback and a light emitting apparatus using the same, so as to extend the service life of the light emitting element.

Another object of the present invention is to provide a switching converter with light intensity as feedback and a light emitting apparatus using the same, so that the light emitting element can have accurately controlled luminous intensity.

To achieve the above and other objects, the present invention provides switching converter for lighting with light intensity as feedback, and the switching converter comprises a conversion circuit, a feedback circuit using light as input, and a control circuit. The conversion circuit is capable of converting an operating electric signal to thereby generate an output electric signal. The feedback circuit comprises a light detecting element capable of detecting an external light to generate a feedback signal. The control circuit is capable of receiving the feedback signal, and comparing the received feedback signal with a reference electric signal, and then controlling the conversion circuit based on comparison results to adjust the output electric signal.

Preferably, the switching converter can be a voltage converter or a voltage-current converter.

Preferably, when the switching converter is a voltage converter, the input electric signal and the output electric signal both are voltage signals.

Preferably, when the switching converter is a voltage-current converter, the input electric signal is a voltage signal, and the output electric signal is a current signal.

To achieve the above and other objects, the present invention further provides a light emitting apparatus comprising a light emitting element and a switching converter. The light emitting element is capable of receiving a driving electric signal to thereby emit light. The switching converter comprises a conversion circuit, a feedback circuit using light as input, and a control circuit. The conversion circuit is capable of converting an operating electric signal to thereby generate the driving electric signal. The feedback circuit comprises a light detecting element capable of detecting luminous intensity of light emitted from the light emitting element to generate a feedback signal. The control circuit is capable of receiving the feedback signal and comparing the received feedback signal with a reference electric signal, and then controlling the conversion circuit according to comparison results to adjust the driving electric signal.

Preferably, the switching converter can be a voltage converter or a voltage-current converter.

Preferably, when the switching converter is a voltage converter, the input electric signal and the driving electric signal both are voltage signals.

Preferably, when the switching converter is a voltage-current converter, the input electric signal is a voltage signal and the driving electric signal is a current signal.

To achieve the above and other objects, the present invention provides a light emitting apparatus comprising a light emitting element and a switching converter. The light emitting element is capable of receiving a driving electric signal to thereby emit light. The switching converter comprises a conversion circuit, a feedback circuit using light as input, and a control circuit. The conversion circuit is capable of converting an operating electric signal to thereby generate the driving electric signal. The feedback circuit comprises a light detecting element capable of detecting luminous intensity of ambient light to generate a feedback signal. The control circuit is capable of receiving the feedback signal and comparing the received feedback signal with a reference electric signal, and then controlling the conversion circuit according to comparison results to stop or enable the conversion circuit outputting the driving electric signal.

Preferably, the switching converter can be a voltage converter or a voltage-current converter.

Preferably, when the switching converter is a voltage converter, the input electric signal and the driving electric signal both are voltage signals.

Preferably, when the switching converter is a voltage-current converter, the input electric signal is a voltage signal and the driving electric signal is a current signal.

With the above arrangements, the light emitting apparatus and the switching converter thereof according to the present invention have one or more of the following advantages:

(1) Compared to the prior art, the light emitting apparatus use solely light as feedback signal source without using any voltage or current as feedback signal source.
(2) Compared to the prior art, the light emitting apparatus of the present invention can provide higher power efficiency and lower power consumption.
(3) Compared to the prior art, the light emitting apparatus of the present invention can more accurately adjust luminous intensity and colors of lights emitted from the light emitting element.
(4) Compared to the prior art, the light emitting apparatus of the present invention can enable the light emitting element thereof to have extended service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
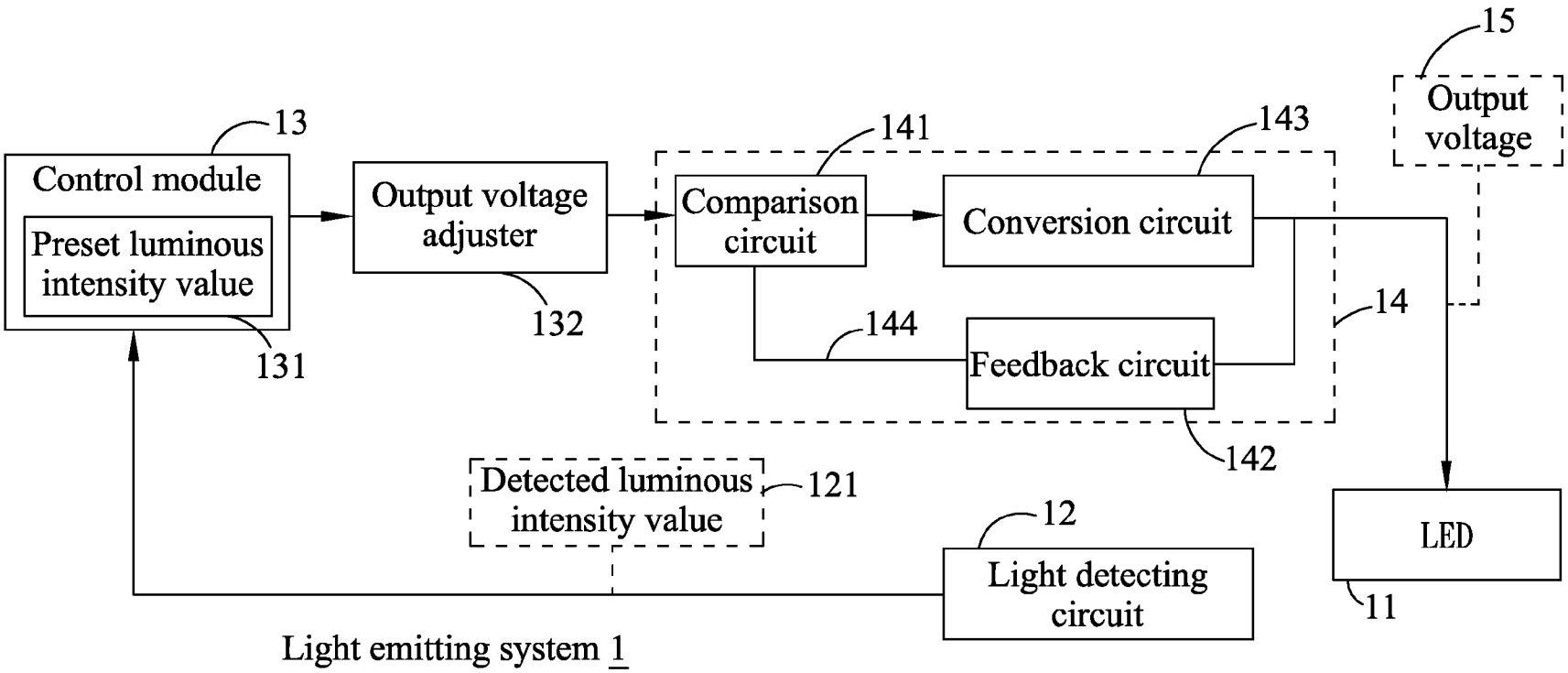
FIG.1(PRIOR ART)
FIG. 1 is a block diagram of a light emitting system in prior art.
Figure 2:
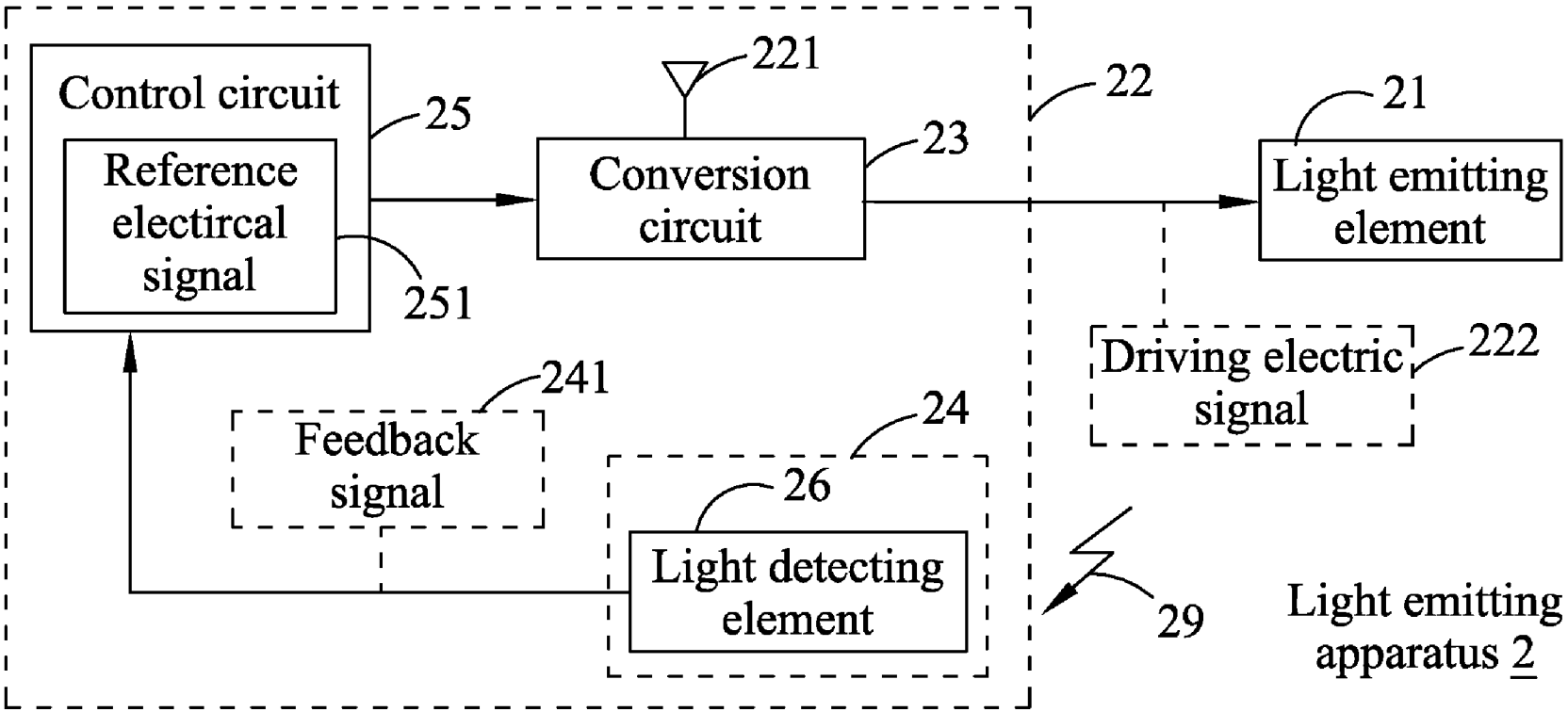
FIG. 2 is a block diagram of a light emitting apparatus according to the present invention.

Referring to FIG. 2 for a block diagram of a light emitting apparatus according to the present invention, as shown, a light emitting apparatus 2 comprises a light emitting element 21 and a switching converter 22. The switching converter 22 receives an input electric signal 221 and outputs a driving electric signal 222 to the light emitting element 21 for driving the light emitting element 21 to emit light. The switching converter 22 comprises a conversion circuit 23, a feedback circuit 24, and a control circuit 25. The conversion circuit 23 is used to convert the input electric signal 221 to the driving electric signal 222. The feedback circuit 24 comprises at least one light detecting element 26 capable of detecting luminous intensity of an external light 29 to generate a feedback signal 241. The control circuit 25 is operable to receive the feedback signal 241 and compare the received feedback signal 241 with a reference electric signal 251, and then control the conversion circuit 23 according to comparison results. Preferably, reference electric signal 251 can be a reference voltage value or a reference parameter.

Preferably, the operation mode of the control circuit 25 can be varied according to the application of the light emitting apparatus 2. For example, when the light detecting element 26 is arranged at a position close to the light emitting element 21 for detecting luminous intensity of light emitted from the light emitting element 21, it means that the external light 29 in this case is the light emitted from the light emitting element 21. Thus, the control circuit 25 controls the conversion circuit 23 based on comparison results to adjust the driving electric signal 222 generated by the conversion circuit 23 to change the luminous intensity of the light emitting element 21, so that the luminous intensity can be maintained at a level represented by the reference electric signal 251.

On the other hand, when the light detecting element 26 is arranged at a position for detecting the luminous intensity surrounding the light emitting apparatus 2, it means that the external light 29 in this case is the ambient light. In this case, the control circuit 25 is operable to control the conversion circuit 23 based on the comparison results to stop or enable outputting of the driving electric signal 222. That is, when the light emitting apparatus 2 is in an environment having luminous intensity higher than that represented by the reference electric signal 251, it means that the ambient light is bright enough and it is not necessary for the light emitting apparatus 2 to emit light. Thus, the conversion circuit 23 is controlled to stop outputting the driving electric signal 222 until the luminous intensity of ambient light becomes lower than that represented by the reference electric signal 251. Then, the control circuit 25 controls the conversion circuit 23 to start outputting the driving electric signal 222, so as to drive the light emitting element 21 to emit light. In this manner, power consumption by the light emitting apparatus 2 can be reduced.

Preferably, the conversion circuit 23 of the switching converter 22 can be a voltage converter or a voltage-current converter. When the conversion circuit 23 of the switching converter 22 is a voltage converter, both the input electric signal 221 and the driving electric signal 222 are voltage signals. Alternatively, when the conversion circuit 23 of the switching converter 22 is a voltage-current converter, the input electric signal 221 is a voltage signal and the driving electric signal 222 is a current signal.

Preferably, the light emitting element 21 can be a light emitting diode or a cold cathodic fluorescent lamp (CCFL). The light emitting element 21 can further comprise a plurality of light emitting diodes of different colors, and the feedback circuit 24 can correspondingly include a plurality of light detecting elements 26. In this case, each of the light detecting elements 26 is provided with a filter, so that the light detecting elements 26 can respectively detect the luminous intensity of light with different colors. With these arrangements, the control circuit 25 can further maintain or adjust the colors or the color temperatures of the lights emitted from the light emitting element 21.

Depending on different types of control circuit 25, the feedback circuit 24 can further include various elements. For instance, when the control circuit 25 is a digital controller, the feedback circuit 24 can further include an analog-to-digital converter (ADC) correspondingly; and when the control circuit 25 is an adder, the feedback circuit 24 can further include an inverter correspondingly; The feedback circuit 24 can further comprise various light detecting circuit for different light detecting element 26. The light detecting element 26 preferably comprises a silicon photodiode or a CdS photoresistor.

Further, the switching converter 22, if necessary, can further include a charge pump circuit and a mode selection circuit. Preferably, the control circuit 25 can comprises a microcontroller, or circuit having adder or comparator.

Figure 3:
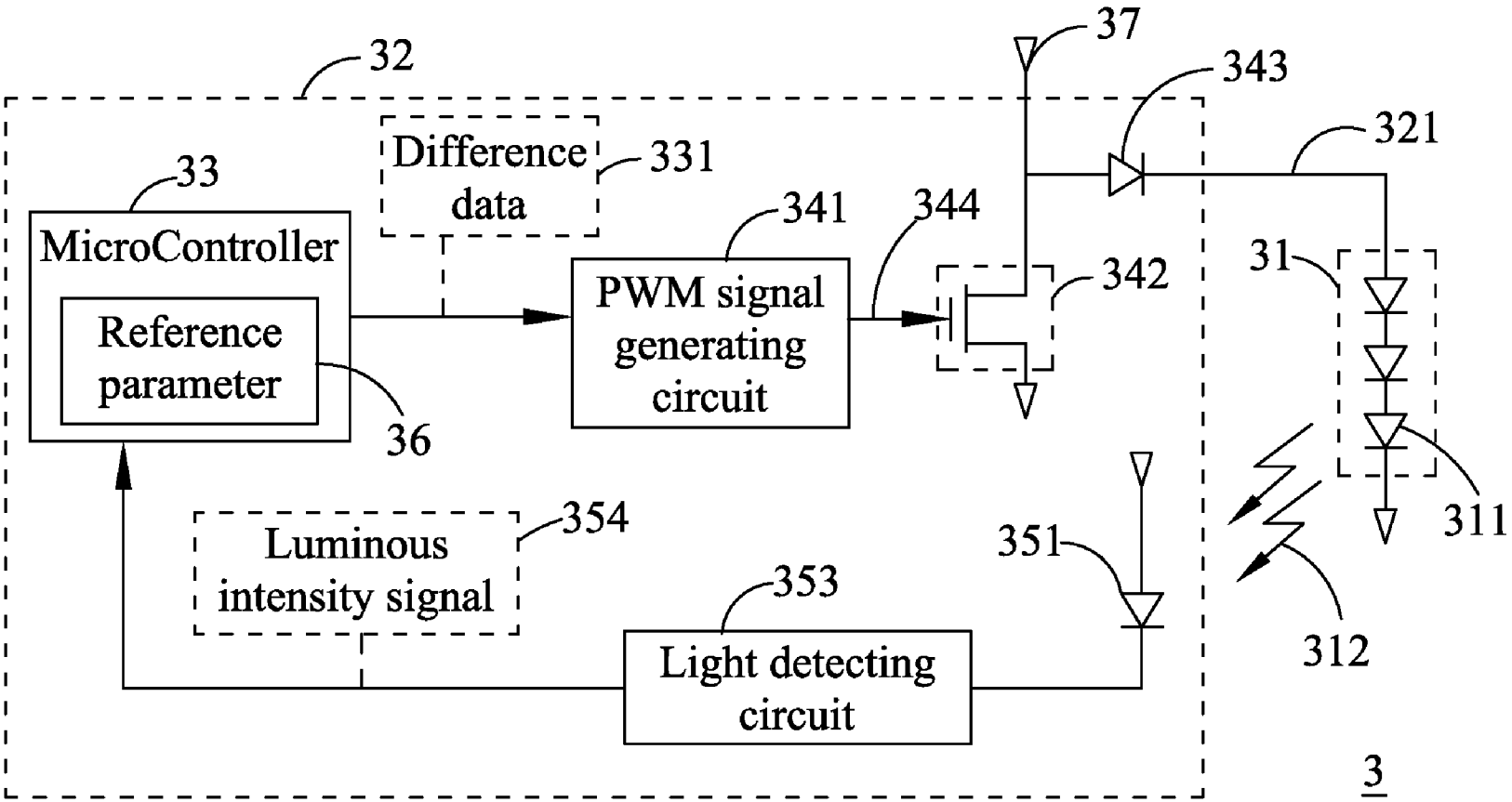
FIG. 3 is a schematic view of a light emitting apparatus according to a first embodiment of the present invention.

FIG. 3 illustrates a schematic view of a light emitting apparatus according to a first embodiment of the present invention. The light emitting apparatus 3 comprises a light emitting diode module 31 and a voltage converter 32. The light emitting diode module 31 comprises a plurality of light emitting diodes 311. In the illustrated embodiment, the light emitting diodes 311 are connected in series. However, the light emitting diodes 311 can be otherwise connected in parallel according to actual need. The light emitting diode module 31 receives a driving voltage 321 output by the voltage converter 32 and the light emitting diodes 311 are then driven to emit light beams 312.

The voltage converter 32 comprises a microcontroller 33, a pulse width modulation (PWM) signal generating circuit 341, a transistor 342, a diode 343, a silicon photodiode 351 and a light detecting circuit 353. One terminal of the silicon photodiode is connected with an input voltage, and another terminal is connected to the light detecting circuit 353. When the silicon photodiode 351 receives the light beams 312, the silicon photodiode 351 generates a photocurrent corresponding to the luminous intensity of the light beams 312, and the photocurrent flows through the light detecting circuit 353 which then outputs a luminous intensity signal 354 to the microcontroller 33.

The microcontroller 33 is operable to calculate a difference data 331 between the reference parameter 36 and luminance value represented by the luminous intensity signal 354 and output difference data 331 to the PWM signal generating circuit 341. The PWM signal generating circuit 341, based on the difference data 331, generates a corresponding PWM signal 344 for controlling the transistor 342 to turn on or turn off. During a low-potential period of the PWM signal 344, the transistor 342 is turned off and the diode 343 is turned on, so that the light emitting diode module 31 can receive a driving voltage 321 to emit light. On the other hand, during a high-potential period of the PWM signal 344, the transistor 342 is turned on and the diode 343 is turned off, so that the light emitting diode module 31 does not receive any driving voltage 321 and stop emitting light. Therefore, by regulating a duty cycle of the PWM signal 344, that is, by regulating a ratio of the high-potential period to the low-potential period of the PWM signal 344, it is able to adjust the luminous intensity of the light emitting diode module 31.

Figure 4:
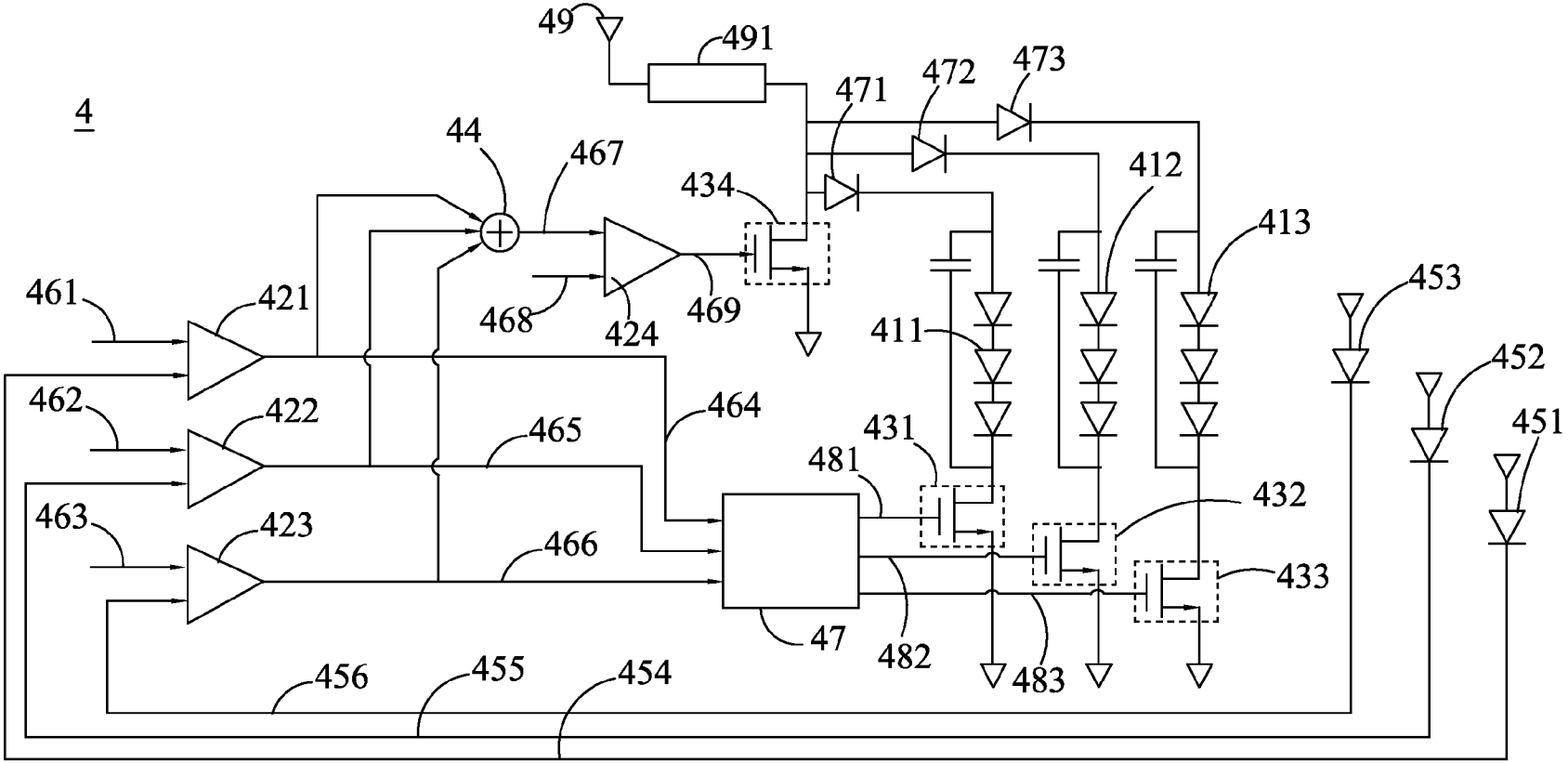
FIG. 4 is a schematic view of a light emitting apparatus according to a second embodiment of the present invention.

FIG. 4 illustrates a schematic view of a light emitting apparatus according to a second embodiment of the present invention. The light emitting apparatus 4 comprises a plurality of serially connected red light emitting diodes (LEDs) 411, a plurality of serially connected green LEDs 412, a plurality of blue LEDs 413, a plurality of comparators 421~424, a plurality of transistors 431~434, an adder 44, a plurality of silicon photodiodes 451~453, a plurality of diodes 471~473, and a time slot controller 47.

The comparator 424, the transistor 434, and the diodes 471~473 are used to control the luminous intensity of the light emitting apparatus 4, and the time slot controller 47 and the transistors 431~433 are used to control the ratio of red light, green light, and blue light to one another in order to adjust the light colors or color temperatures of the light emitting apparatus 4. The silicon photodiodes 451~453 are respectively provided with a red filter, a green filter, and a blue filter for detecting the luminous intensity of the red light, the green light, and the blue light in the light beams emitted from the LEDs 411~413. For the purpose of easy to understand, the above-mentioned filters are not shown in FIG. 4.

The operation manner of the silicon photodiodes 451~453 is similar to that of the silicon photodiode 351 shown in FIG. 3. When the silicon photodiodes 451~453 receive the light beams emitted from the LEDs 411~413, they generate a red light intensity voltage value 454, a green light intensity voltage value 455, and a blue light intensity voltage value 456, respectively. The comparators 421~423 respectively have an input for receiving a red light reference voltage value 461, a green light reference voltage value 462, and a blue light reference voltage value 463, and another input for receiving the red light intensity voltage value 454, the green light intensity voltage value 455, and the blue light intensity voltage value 456. Each of the comparators 421~423 calculates a difference value between the signal values input at the two inputs thereof, and therefore, the comparators 421~423 respectively output at an output thereof a red light difference value 464, a green light difference value 465, and a blue light difference value 466. The light difference values 464, 465, 466 are then sent to the adder 44 for summing. Meanwhile, the light difference values 464, 465, 466 are also sent to the time slot controller 47. The adder 44 outputs a sum signal 467 to an input of the comparator 424. The comparator 424 has another input for receiving a sawtooth signal 468, and an output for outputting a difference signal 469 to the transistor 434. The difference signal 469 represents a difference between the sum signal 467 and the sawtooth signal 468. Please also refer to FIG. 5. While the sum signal 467 is lower than the sawtooth signal 468, the difference signal 469 is at negative potential, as represented by the time slot 51. On the other hand, while the sum signal 467 is higher than the sawtooth signal 468, the difference signal 469 is at positive potential, as represented by the time slot 52.

Figure 5:
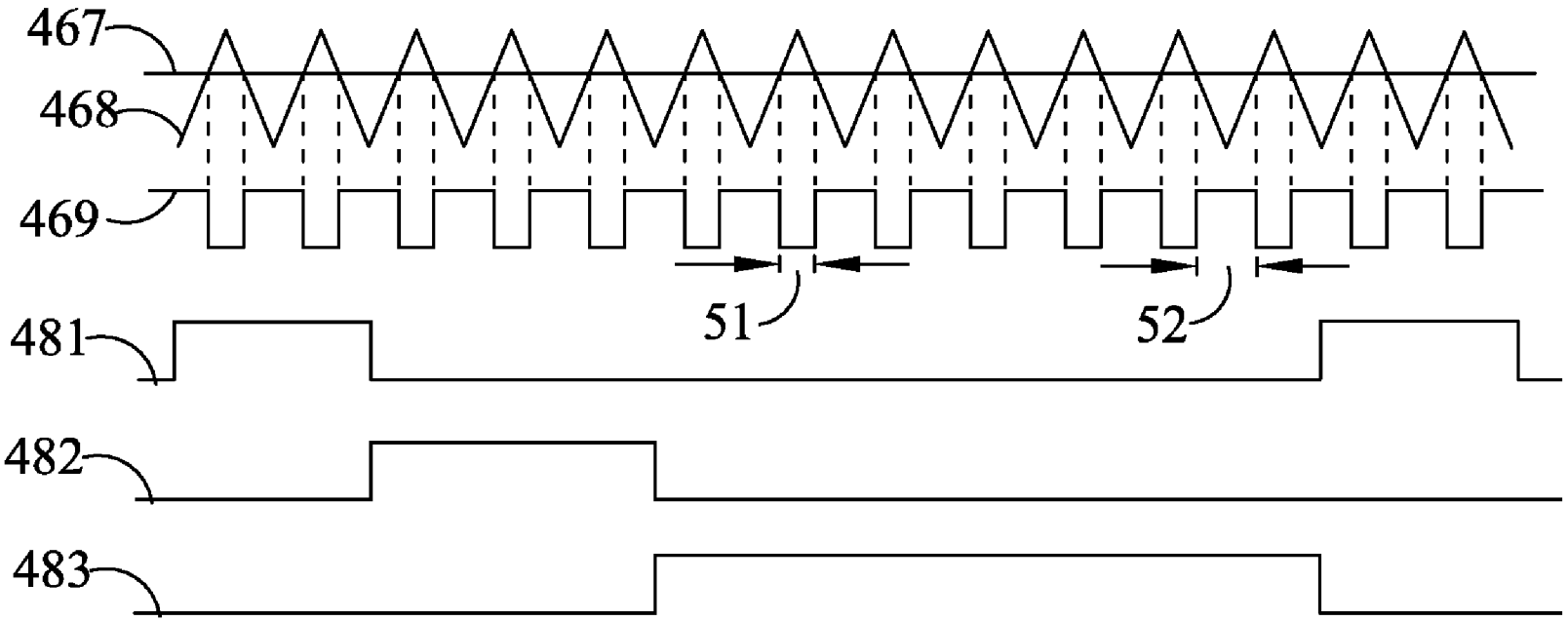
FIGS. 5 to 7 illustrate some examples of signal waveform of the light emitting apparatus according to the second embodiment of the present invention.
Figure 6:
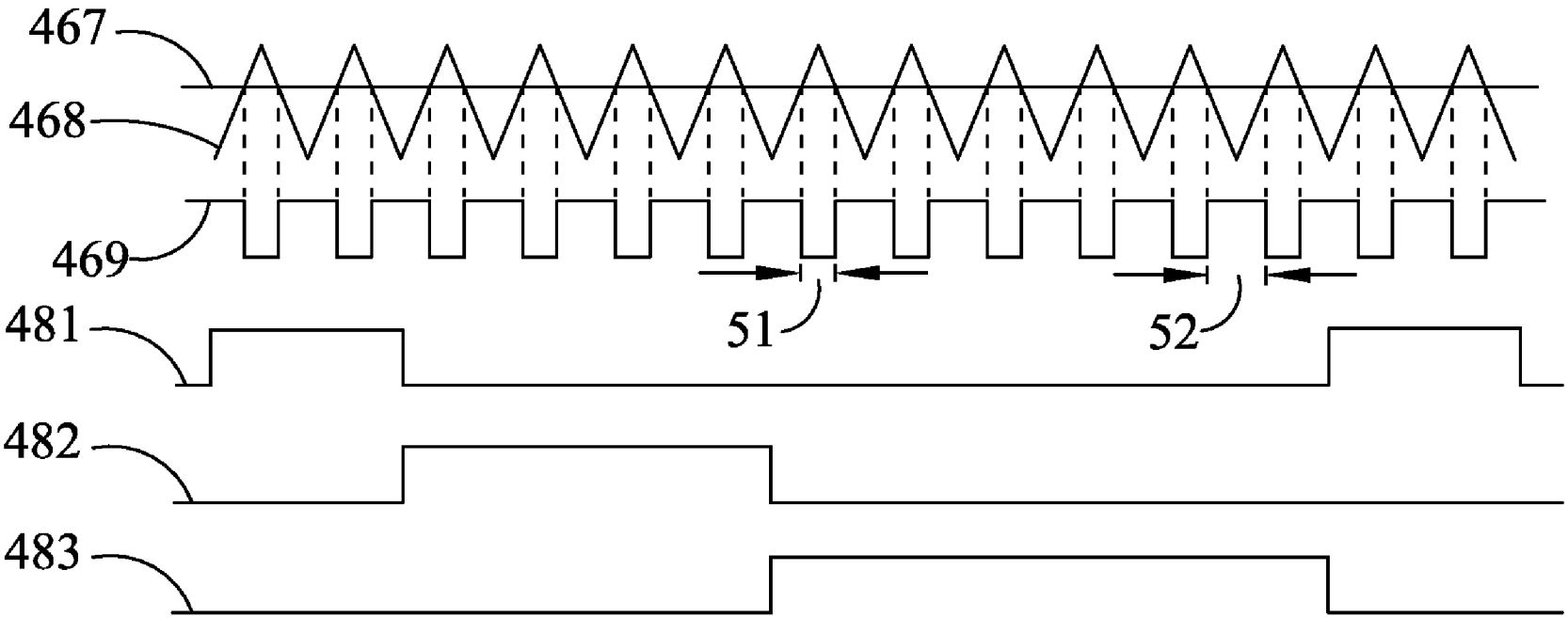
Figure 7:
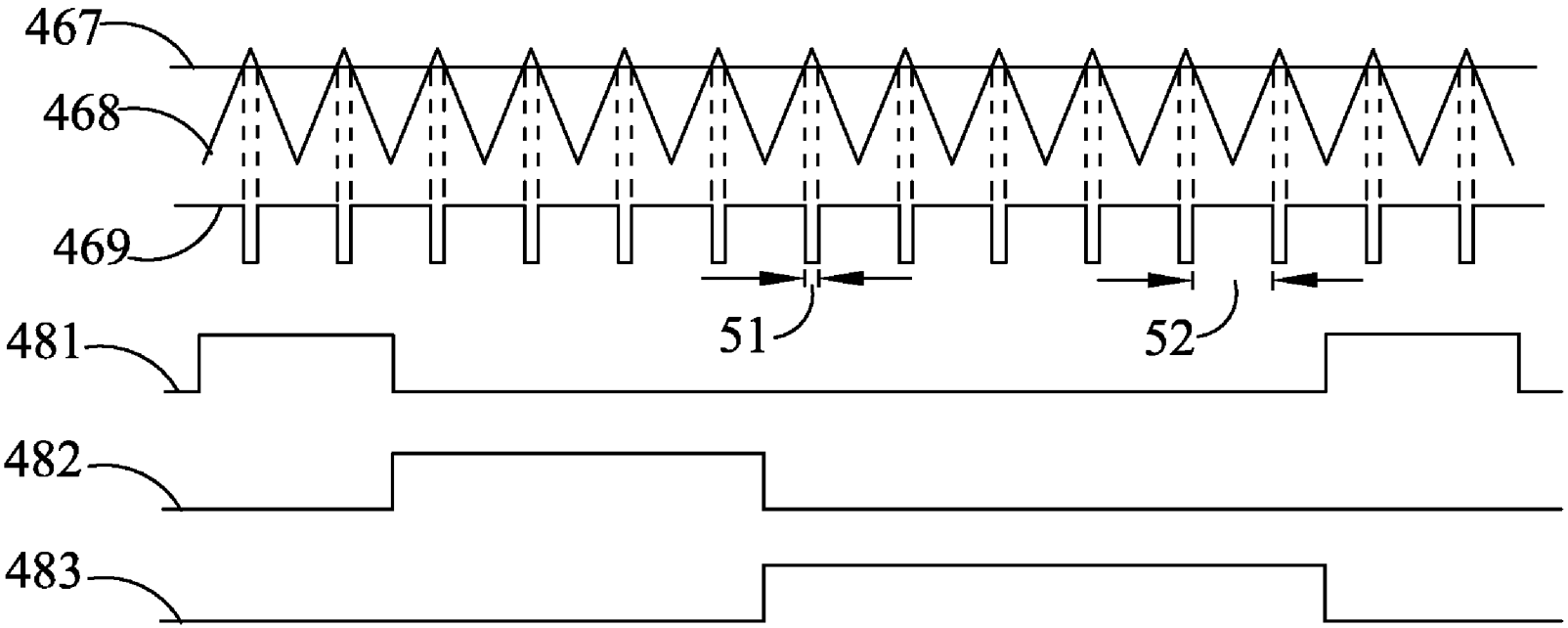

The time slot controller 47 receives the red light difference value 464, the green light difference value 465, and the blue light difference value 466, and outputs corresponding red light emitting control signal 481, green light emitting control signal 482, and blue light emitting control signal 483, waveforms of which are shown in FIG. 5. The red light emitting control signal 481, green light emitting control signal 482, and blue light emitting control signal 483 are all periodic signals with period being a multiple of the period of the difference signal 469. In FIG. 5, the period of the light emitting control signals 481, 482, 483 equal to twelve periods of the difference signal 469 are taken for example. During low potential time slot of the difference signal 469, the diodes 471~473 are turned on, and if the light emitting control signals are high-potential at this point, the transistors connected to the LEDs are then turned on correspondingly, so that electric current can be supplied to the LEDs for driving the LEDs to emit lights. Taking what is shown in FIG. 5 as an example, the red LED 411 is driven to emit light during two time slots 51, the green LED 412 is driven to emit light during three time slots 51, and the blue LED 413 is driven to emit light during seven time slots 51. It is supposed that the LEDs have the same luminous efficiency, therefore, the light emitting apparatus 4 emits red light, green light, and blue light in a ratio of 2:3:7 according to the difference signal 469 and the control signals 481, 482, 483 shown in FIG. 5. In the event, if the blue light is too strong and the green light is too weak in the emitted light in comparison with a preset ratio, the time slot controller 47 can reduce the time period of high-potential part of the blue light emitting control signal 483 and extend the time period of high-potential part of green light emitting control signal 482, as shown in FIG. 6. In this manner, the ratio of the red light, the green light, and the blue light emitted from the light emitting apparatus 4 can be adjusted to be 2:4:6 without changing the luminous intensity of the light emitting apparatus 4. The above-described adjustment can be repeated until the red light difference value 464, the green light difference value 465, and the blue light difference value 466 are approximate to zero. Moreover, if the luminous intensity of the light emitting apparatus 4 becomes too low, and it leads to the raise of voltage value of sum signal 467, as shown in FIG. 7. The raised voltage of the sum signal 467 causes reduction of the time period of the time slot 51 and extension of the time period of the time slot 52, it means that the driving time period for the inductance 491 is increased, resulting in intensified inductance energy to thereby increase, so that the light emitting apparatus 4 can be driven by a larger power during the time period of time slot 51 to emit light with the stronger luminous intensity. Therefore intensity of light emitted by the light emitting apparatus 4 can be adjusted without varying the ratio of the red light, the green light, and the blue light. Similarly, When the luminous intensity of the light emitting apparatus 4 becomes too strong, voltage value of the sum signal 467 becomes lower correspondingly, and it leads to extension of the time period of the time slot 51 and reduction of the time period of the time slot 52, so that the luminous intensity of the light emitting apparatus 4 becomes weaker under keeping its light color.

It should be noted that, in the above-described first and second embodiments, the luminous intensity of the light emitting apparatus is adjusted by changing the driving voltage thereof. However, a person can also employ the concept of the present invention to design a voltage-current converter having a light-detector without being limited to the first and the second embodiment, so that the voltage-current converter can output a driving current to drive LEDs to emit light. Therefore, such light emitting apparatus also falls in the scope of the present invention.

Figure 8:
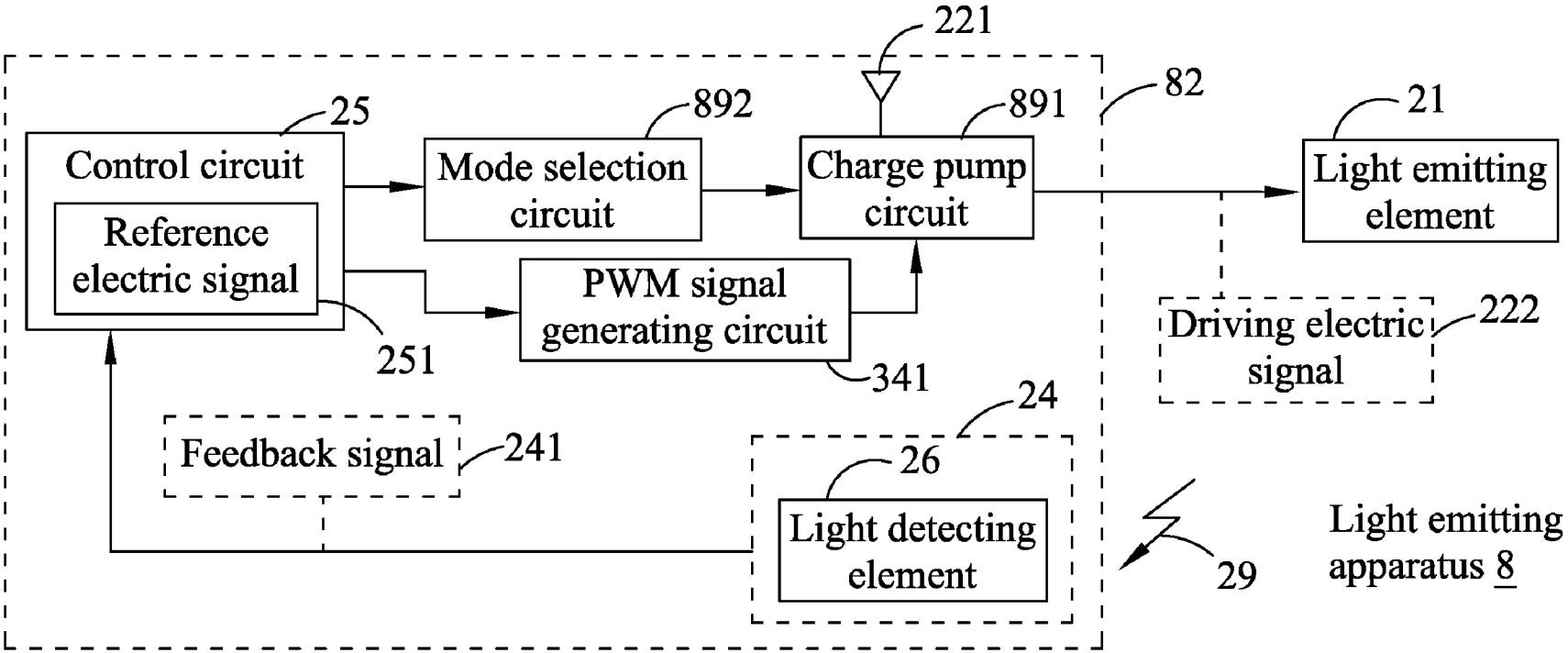
FIG. 8 is a block diagram of a light emitting apparatus according to a third embodiment of the present invention.

FIG. 8 illustrates a block diagram of a light emitting apparatus according to a third embodiment of the present invention. The light emitting apparatus 8 in the third embodiment differs from the first and second embodiments in that the voltage converter 82 of the light emitting apparatus 8 comprises a charge pump circuit 891 and a mode selection circuit 892. When the light detecting element 26 detects a luminous intensity that is so weak that even a PWM signal having a 100% duty cycle output by the PWM signal generating circuit 341 could not drive the light emitting element 21 to emit light with a preset luminous intensity, the mode selection circuit 892 can set the charge pump circuit 891 to a 1.5-fold boosting mode or a 2-fold boosting mode to increase the magnitude of the driving voltage, so that the light emitting element 21 can be driven to emit the preset luminous intensity.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A switching converter for lighting with light intensity as feedback, comprising:

a conversion circuit capable of converting an operating electric signal to generate an output electric signal;

a feedback circuit including a light detecting element capable of detecting an external light to generate a feedback signal; and a control circuit capable of receiving the feedback signal, and comparing the received feedback signal with a reference electric signal, and controlling the conversion circuit based on comparison results to adjust the output electric signal;

wherein the conversion circuit of the switching converter is a voltage-current converter, the operating electric signal is a voltage signal, and the output electric signal is a current signal.

2. The switching converter as claimed in claim 1, wherein the switching converter is a voltage converter, and the operating electric signal and the output electric signal each are a voltage signal.

3. The switching converter as claimed in claim 1, wherein the control circuit comprises at least a PWM signal generating circuit and a switching element.

4. The switching converter as claimed in claim 1, wherein the light detecting element comprises a silicon photodiode or a CdS photoresistor.

5. A light emitting apparatus, comprising:

a light emitting element capable of receiving a driving electric signal to thereby emit light; and a switching converter comprising:

a conversion circuit capable of converting an operating electric signal to generate the driving electric signal;

a feedback circuit including a light detecting element capable of detecting a luminous intensity of light emitted from the light emitting element and generating a feedback signal; and a control circuit capable of receiving the feedback signal, and comparing the received feedback signal with a reference electric signal, and controlling the conversion circuit based on comparison results to adjust the driving electric signal;

wherein the conversion circuit of the switching converter is a voltage-current converter, the operating electric signal is a voltage signal, and the output electric signal is a current signal.

6. The light emitting apparatus as claimed in claim 5, wherein the switching converter is a voltage converter, and the operating electric signal and the output electric signal each are a voltage signal.

7. The light emitting apparatus as claimed in claim 5, wherein the control circuit comprises at least a PWM signal generating circuit and a switching element.

8. The light emitting apparatus as claimed in claim 5, wherein the light detecting element comprises a silicon photodiode or a CdS photoresistor.

9. The light emitting apparatus as claimed in claim 5, wherein the light emitting element comprises a light emitting diode (LED) or a cold cathodic fluorescent lamp (CCFL).

10. A light emitting apparatus, comprising:

a light emitting element capable of receiving a driving electric signal to thereby emit light beams;

a switching converter comprising:

a conversion circuit capable of converting an operating electric signal to generate the driving electric signal;

a feedback circuit including a light detecting element capable of detecting a luminous intensity of ambient light and generating a feedback signal; and a control circuit capable of receiving the feedback signal, and comparing the received feedback signal with a reference electric signal, and controlling the conversion circuit based on comparison results to stop or enable outputting of the driving electric signal;

wherein the conversion circuit of the switching converter is a voltage-current converter, the operating electric signal is a voltage signal, and the output electric signal is a current signal.

11. The light emitting apparatus as claimed in claim 10, wherein the switching converter is a voltage converter, and the operating electric signal and the output electric signal each are a voltage signal.

12. The light emitting apparatus as claimed in claim 10, wherein the control circuit comprises at least a PWM signal generating circuit and a switching element.

13. The light emitting apparatus as claimed in claim 10, wherein the light detecting element comprises a silicon photodiode or a CdS photoresistor.

14. The light emitting apparatus as claimed in claim 10, wherein the light emitting element comprises a light emitting diode (LED) or a cold cathodic fluorescent lamp (CCFL).

* * * * *